United States Patent [19]

Rosenwinkel et al.

[11] Patent Number: 4,572,224

[45] Date of Patent: Feb. 25, 1986

[54] UNITARY TUBULAR STORAGE RECEPTACLE WITH RESTRICTED FLUID DISPENSING CONTROL PASSAGE

[75] Inventors: Karen W. Rosenwinkel, Oak Park, Ill.; Jerry R. Jinks, Kendall Park, N.J.

[73] Assignee: W. Braun Company, Chicago, Ill.

[21] Appl. No.: 664,161

[22] Filed: Oct. 24, 1984

[51] Int. Cl.[4] ..... A45D 40/00

[52] U.S. Cl. ..... 132/88.5; 132/88.7

[58] Field of Search ..... 132/88.5, 88.7, 85; 401/122; 15/257.05

[56] References Cited

U.S. PATENT DOCUMENTS

| | | | |
|---|---|---|---|
| 3,214,782 | 11/1965 | Masters et al. | 401/122 |
| 3,892,248 | 7/1975 | Kingsford | 132/88.7 |
| 3,930,280 | 1/1976 | Vasas | 401/122 |
| 4,411,282 | 10/1983 | Wavering | 132/88.5 |

*Primary Examiner*—Gregory E. McNeill

*Attorney, Agent, or Firm*—Michael G. Berkman

[57] ABSTRACT

A unitary, integrally-formed, tubular receptacle serving as a storage receptacle from which fluid or fluid-like material is retrieved and applied by means of an insertable rod-like wand. The receptacle includes a container body of an elongated tubular configuration and integrally connected at its upper open end by means of an annular washer-like flange to a neck of substantially reduced diameter and defining a restricted internal passage having a radially inwardly directed annular wiping ring. The neck opens upwardly into a dish-like open-end throat having a curved lower sector defining a downwardly and inwardly directed wall surface serving as a guideway for entry of a wand downwardly through the restricted passage and also as a drain for facilitating return of excess wand-carried fluid material to the storage reservoir of the receptacle.

10 Claims, 4 Drawing Figures

UNITARY TUBULAR STORAGE RECEPTACLE WITH RESTRICTED FLUID DISPENSING CONTROL PASSAGE

BACKGROUND OF THE INVENTION

The present invention relates to a receptacle for the storage of fluid and fluid-like cosmetic products and other products of the type conveniently applied by means of a wand, brush or equivalent applicator. More particularly, the invention is directed to an elongated, integrally-formed, unitary plastic storage and dispensing container which includes in a zone intermediate the receptacle's mouth and the product-retaining storage reservoir of the receptacle a lineal zone coaxial with the receptacle but materially constricted radially to define an interior passage for limiting and controlling discharge and removal of products stored in the container base or reservoir of the receptacle.

Receptacles for dispensing fluid and fluid-like products with the aid of elongated applicators or wands are well-known. Applicator devices have been used in various forms including rods, rods with end beads, rods carrying brushes, wires, spring-like bars, and platelets. Such applicator structures find utility in applying medicinals, nail polish compositions, liquids used in stenographic procedures, mascara formulations and many other and varied products.

The product storage receptacles for such use have taken many and diverse physical forms and have been made using different manufacturing methods and techniques. Plastic containers which include an internal restricted passage for controlling and regulating the removal of the contents of the receptacle are also known. Invariably, however, such plastic receptacles have been made by assembly from a plurality of distinct, separate parts. In some instances auxiliary inserts have been used to achieve the desired interior structure. In other arrangements the several separate parts have been cemented or fused to one another to produce the arrangement sought, including a restricted interior passage for controlling removal of the wand-carried material from the storage reservoir of the receptacle.

The mechanical assembly of receptacles from multiple components is a time-consuming and costly procedure, as is the introduction of press-fit or cemented inserts. Moreover, the multiple molds and molding operations involved further add to the overall cost. It is, therefore, a principal aim of the present invention to obviate the shortcomings of prior art receptacles of the general type involved and to provide a unitary, integrally-formed, molded plastic receptacle devoid of separate, multiple elements or auxiliary inserts, and which includes features, including a markedly restricted metering passage, not heretofore present in a unitary, molded plastic structure which has an elongated body defining a product reservoir having a large diameter as compared with that of the limiting constriction.

Specifically, there is herein provided an integrally formed, unitary receptacle having a limiting, restricted entry port to the vessel proper and in which the length dimension of the reservoir of the receptacle exceeds by a factor greater than ten the internal diameter of the restricted port or limiting passage. No such structure has heretofore been known in the art.

SUMMARY OF THE INVENTION

It is a principal feature of the present invention that there is provided a plastic receptacle for use with a wand-like applicator or dispensing rod and in which the receptacle is molded as an integral, unitary configuration including an internally formed restricted limiting passage in a zone intermediate an open mouth of the relatively elongated receptacle and the storage reservoir or principal chamber of the receptacle.

In a preferred embodiment the receptacle of the invention is elongated and generally tubular and defines a radially restricted zone or neck intermediate the top opening and the lower, vial-like reservoir of the receptacle. The receptacle itself has a transverse diameter markedly greater than that of the limiting passage in the restricted zone.

A very important feature of the present invention is that there is provided an integrally formed elongated unitary receptacle including a restricted limiting port or passageway in which the length of the reservoir of the receptacle exceeds by a factor greater than ten the internal diameter of the limiting port.

An important feature of the receptacle of the invention is an annular bead-like ring integrally formed in the neck-like portion of the receptacle and extending radially inwardly thereof to constitute a wiping sleeve to limit the quantity of material carried on the probe-like dispensing rod as the latter is withdrawn from the storage chamber or product reservoir of the receptacle.

Another feature of the receptacle of the invention is that an open mouth and throat assembly surmounting and communicating with the neck-like restricted portion of the receptacle is formed at a lower portion of the assembly to define an inwardly curved, dish-like sector integrally joined at a narrowed base thereof to an upper edge of the restricted neck portion of the receptacle. The wall of the dish-like sector functions as a lead-in guide for directing a wand-like rod through the neck portion and into the vial-like reservoir of the receptacle. Still another feature of the receptacle of the invention is that the tubular body of the reservoir of the receptacle is integrally formed at its upper limit with a transverse flange extending radially inwardly and integrally joined to a base of the restricted neck portion of the receptacle.

A related feature of the receptacle is that the flange connecting the reservoir of the receptacle with the surmounting neck portion is formed with a shoulder for abutting engagement with the base of a cap-like closure for the receptacle.

Yet another feature of the receptacle is that the mouth and throat assembly is formed on an outer, circumscribing wall thereof with threads for mating engagement with cooperating threads formed on a closure cap for the receptacle.

In a preferred embodiment of the invention the closure cap and the applicator wand are used as a unitary structure, the cap serving as a handle.

It is a collateral feature of the invention that the wand is adapted for penetrating passage through the constricted neck portion of the receptacle into and from the storage reservoir and thus engages the annular wiping ring or bead in the neck portion of the receptacle so as stressingly to engage and resiliently to deform and wipe radially extending structures such as bristles, rings, discs, ribs, flexible cone structures and pads, of rubber, plastic, natural fibers, fabrics and other materials carried by the applicator wand, thus to wipe excess material from the wand as the latter is withdrawn from the receptacle for use.

A related feature of the invention is that the restricted neck section serves also to control the quantity of material carried from the reservoir on the probe elements of rigid configuration, including probes in the form of end-baded rods.

Yet another feature of the invention is that the mouth of the vessel includes a radially inwardly curved, dish-like lower section for directing return of excess material into the reservoir of the receptacle.

Other and further objects, features and advantages of the invention will become evident from the following detailed description considered with the drawing.

DESCRIPTION OF THE PREFERRED EMBODIMENT

The aims and objects of the invention are achieved using a plastic molding process in which blow molding techniques have been combined with an injection molding operation. The blow molding technique generates the body or reservoir portion of the receptacle and the injection molding operation produces the restricted neck, the applicator wiping bead or ring structure and the mouth and throat assembly of the receptacle.

As carried out, the molding process results in a unitary, integrally formed receptacle with no glued or fused elements and no inserts. In producing the product of the present invention and effectuating the novel structure of the receptacle, the molding experience and expertise of Captive Plastic Company of New Jersey, U.S.A., have been invoked. In the light of the present disclosure, those skilled in the art will be able to produce containers which embody the structural principles and features of the present invention, and will be able so to do without the exercise of the inventive faculty.

The improved, unique receptacle of the invention constitutes an elongated, vial-like product storage vessel or reservoir surmounted by an integrally formed neck-like constricted or restricted zone joined in turn to a vessel mouth including an integrally threaded bounding wall. The latter, in combination with an abutment shoulder is adapted for secured and sealing engagement with a cap or closure. In the exemplary form of the invention described and illustrated, the closure element is adapted to carry a wand or applicator rod. The wand itself may include any of varied types of applicator elements including but not limited to brushes, special bristle elements, discs, pads, flexible combs, rods, rods including beads at the ends thereof, etc.

In each embodiment of the applicator, the receptacle of the invention, and more specifically the restricted neck-like section including the radially inwardly projecting annular bead, serves effectively to limit and control the quantity of material removed from the storage reservoir of the receptacle as the wand is withdrawn and is pulled through the restricted zone of the receptacle.

It is significant that the present invention teaches and provides a receptacle of a relatively elongated configuration and including a restricted, limiting access port, in which receptacle the overall length of the container itself exceeds by a factor greater than ten the internal diameter of the limiting port. Such a structure and relative proportion of components is unknown in the art embracing integrally formed unitary molded receptacles.

Figure 1:
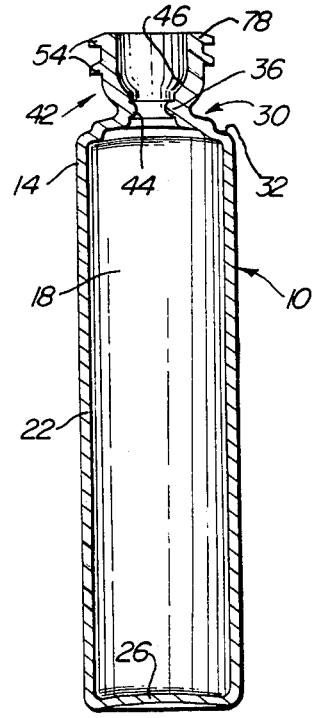
FIG. 1 is a front elevational view, in section, illustrating the receptacle of the invention as an integral, unitary structure.
Figure 2:
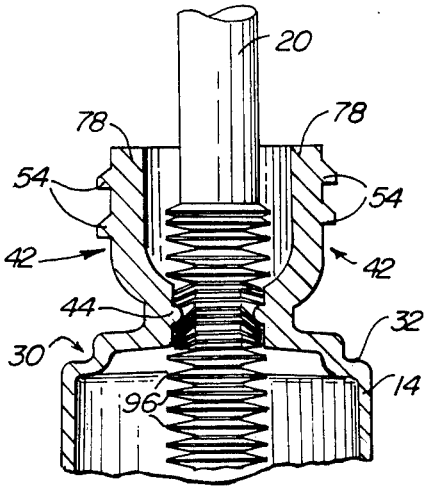
FIG. 2 is an enlarged fragmentary view indicating schematically the wiping action of the rib-like bead as a wand is withdrawn through the restricted neck zone of the receptacle of the invention.

Referring now to the drawings, and more particularly to FIGS. 1 and 2, for purposes of illustrative disclosure and not in any limiting sense, a preferred embodiment of the invention is shown as a unitary, integrally formed, molded plastic receptacle 10. As depicted, the receptacle 10 includes an elongated, vial-like, generally tubular storage vessel 14 defining a product retention chamber or reservoir 18 for holding the material (not shown) to be dispensed.

The vessel 14 is of a substantially rigid plastic, for example, polypropylene and PVC, includes a circumscribing sidewall 22 and a bottom closure 26. The elongated chamber 14 may be round in transverse section, or may be ellipsoid or otherwise contoured, or may be polygonal, etc., as preferred for any particular application or use.

Figure 4:
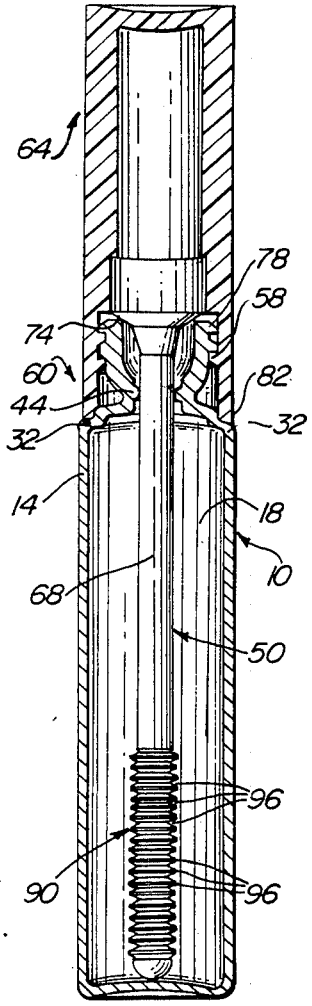
FIG. 4 is a front elevational view, partly in section, illustrating the receptacle of the invention, capped with the applicator wand in its "storage" mode.

At its upper end, the container 14 is integrally formed with a generally inwardly directed flange 30 which is preferably stepped to define a horizontal shoulder 32 for seating and sealing engagement with a cap or closure 40 (FIG. 4). The latter is not a part of the present invention but is described in Wavering U.S. Pat. No. 4,411,282 assigned to the same assignee as is the present invention. The entire disclosure of that patent is hereby specifically incorporated herein by reference to the extent it is not inconsistent herewith.

Surmounting the flange 30 and integrally joined thereto by a restricted neck-like section 36 serving as a material-removal-limiting means in an open-ended, cup-shaped mouth and throat assembly 42. As indicated, the neck-like section is of a somewhat thickened wall formation (and more rigid) as compared with the wall 22 of the reservoir chamber 18.

The neck section 36 is of an inner (and outer) diameter much less than that of the vessel proper 14 and is integrally formed at a zone intermediate its upper and lower ends with a radially inwardly directed bead or ring 44 which serves as a limiting device to control the quantity of material removed from the storage chamber 18 as a wand or probe 50 is withdrawn from the receptacle 10. The precise form, shape, configuration and composition of the wand itself is not a part of the present invention, all types of wands and applicators being contemplated as useful in conjunction with the novel receptacle of the invention.

In the illustrative example depicted, the diameter of the limiting passage in the neck of the receptacle is about 0.17 inch, the chamber of the vessel is about 2½ inches long, and has a diameter of about 5/8-inch. The overall length of the receptacle, including the mouth assembly, is about 3 inches.

The mouth and throat assembly 42 is generally cylindrical in form and of a diameter less than that of the reservoir 14. A lower portion of the assembly 42 is dish-shaped, being curved inwardly 46 to its base where it joins the neck section 36. The curved wall 46 functions both as a guide during insertion of the probe 50 into the receptacle 18 and serves as well to drain or direct excess material to return to the storage chamber 18 of the receptacle 10.

The outer wall of the cup assembly 42 is threaded 54 for mating engagement with cooperating internal threads 58 formed in the hollow, open-ended skirt 60 of the combination handle and closure 64 (FIGS. 3 and 4) of the receptacle 10.

Adjacent its upper end, the shaft 68 of the wand 50 includes a frusto-conical collar 74 or convex flange of a yieldable, pressure-responsive, flexible material. As shown in FIG. 4, the undersurface of the flange 74 resiliently abuts to seal against an inner lip edge portion 78 of the end of the receptacle 10 when the latter is capped. The seal effected augments the seal formed when the ring-like end 82 of the cap skirt 60 seats upon and seals against the shoulder 32 of the receptacle 10 during threaded securement of the closure 64 in place.

Figure 3:
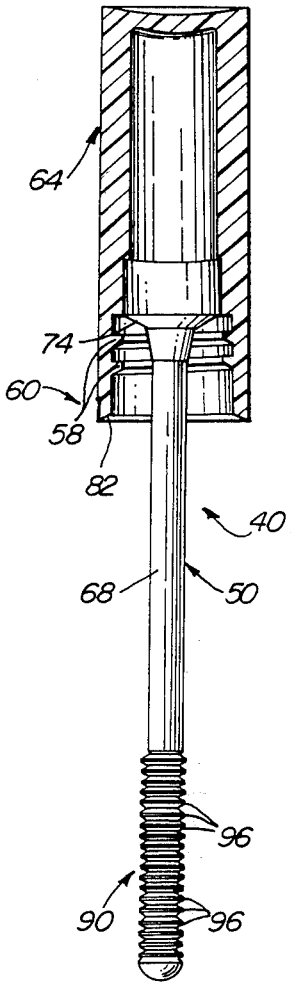
FIG. 3 is a front elevational view, partly in section, showing an exemplary combination applicator wand and container closure for use with the receptacle of the invention.

The wand 50 is conveniently sealed within or frictionally secured within the hollow closure or cap 40 as indicated in FIG. 3. However, neither the closure cap nor the wand assembly 50 is, per se, a part of the present invention, and each may take any preferred form and configuration depending upon the ultimate intended use.

It will be appreciated that the receptacle 10 of the invention has an exceedingly high degree of versatility and is eminently suitable for many different products and many applications.

The "functional" or applicator part 90 of the wand or applicator 50 illustrated is shown only to demonstrate one utility and one method of use of the receptacle 10 of the invention. The particular wand structure illustrated is not to be considered as limiting the present invention in any sense. As best seen in FIG. 2, the lower end of the wand 50 carries a series of resilient and flexible disc-like rings 96 adapted to carry mascara (not shown) from the storage chamber 18 of the receptacle 10. As indicated, the discs 96 have a transverse (diametric) dimension which exceeds slightly that of the limiting or wiping ring or bead 44 so that as the wand is withdrawn from the receptacle, the discs are bent or flexed and excess material (mascara) is removed from the applicator 90 leaving a controlled quantity in place for use.

Irrespective of the type of applicator to be used and the ultimate use intended, in accordance with the practice of the present invention, the unitary receptacle serves the important function of a limiting device to control and regulate the withdrawal of material from the storage cavity 18. This regulation and control is effectuated and effective for applicators which physically engage the radial bead 44 of the receptacle 10, as well as for those which pass through the limiting bead 44 in a clearance mode.

What is claimed is:

1. A receptacle for the storage of fluid and fluid-like preparations to be dispensed therefrom by means of a rod-like dispensing and applicator wand adapted to be protectively and sealingly retained within said receptacle during periods of non-use, said receptacle being of a unitary configuration defining integrally-formed, lineally-arrayed, coaxial components including a base consisting of an elongated, open top reservoir of a lineal depth to receive and to house therewithin substantially the full length of a wand for dispensing materials stored in said reservoir, a neck portion of said receptacle and means supporting said neck portion to surrmount said reservoir, said neck portion defining a substantially reduced access opening into said reservoir, said means supporting said neck portion comprising flange means surmounting and integrally formed with said reservoir and said neck portion of said receptacle and interposed therebetween for coupling said neck portion of said receptacle to said reservoir, said flange means including an annular shoulder portion extending generally normally of a principal bounding vertical, upstanding wall of said receptacle for providing a seal for sealing engagement with an abutting, downwardly-presented lower end face of closure means for capping said receptacle, said neck portion having an outer diameter of an expanse significantly reduced as compared with a transverse dimension of said reservoir, a generally cylindrical, open-ended mouth and throat assembly constituting a tubular section integrally formed with and surmounting said neck portion and defining an entry port for access into said reservoir, said tubular section having an internal diameter greater than that of said neck portion and an outer diameter less than that of a transverse dimension of said reservoir, said tubular section being integrally formed on an outer annular circumscribing wall thereof with thread means for coupling engagement with cooperating thread means carried by the closure means for said receptacle.

2. The structure as set forth in claim 1 wherein said neck portion is integrally formed interiorly thereof with a radially inwardly projecting annular bead-like ring defining a restricted entry port into said reservoir for limiting the quantity of material retrievable from said container upon each successive withdrawal of a material-carrying wand therefrom.

3. The structure as set forth in claim 2 wherein said ring means is positioned in a zone of said neck portion intermediate vertically spaced upper and lower limits of said neck portion.

4. The structure as set forth in claim 1 wherein a lower portion of said tubular section defines interiorly thereof an inwardly curved, dish-like sector integrally joined at a narrowed base thereof to an upper edge of said neck portion of said receptacle, said sector constituting lead-in guide means for directively guiding a wand through said neck portion and into said reservoir, and serving as drain-back conduit means for directing the turn of excess material to said reservoir upon accumulation of material in said sector.

5. The structure as set forth in claim 1 wherein the length dimension of said receptacle exceeds by a factor greater than ten the internal diameter of said restrictive entry portion into said reservoir.

6. The structure as set forth in claim 5 wherein said reservoir of said receptacle is about 2½ inches long and has a diameter of about 5/8-inch, and wherein the internal diameter of said neck portion of said receptacle is about 0.17 inch.

7. A plastic receptacle molded as an integral, unitary structure devoid of fusedly joined and cemented components and devoid of structural inserts, said receptacle comprising an elongated, vial-like, generally tubular reservoir, a restricted neck section integrally joined to and surmounting said reservoir, and a throat and mouth assembly integrally joined to said neck section at an upper end thereof, said reservoir of said receptacle being of a length which exceeds by more than a factor of ten an internal diameter dimension of said neck section.

8. The structure as set forth in claim 7 and further comprising a radially inwardly directed annular bead integrally formed interiorly of said neck section on an inside wall thereof, said bead comprising a limiting device for controlling the removal of material contained in said reservoir.

9. The structure as set forth in claim 8 wherein said bead is positioned lineally in a zone intermediate upper and lower limits of said neck section.

10. The structure as set forth in claim 9 wherein said bead is in a zone essentially midway between upper and lower limits of said neck section.

* * * * *